United States Patent [19]

Diller

[11] 4,242,893

[45] Jan. 6, 1981

[54] STOP COLLAR FOR TUBE EXPANDER

[75] Inventor: Charles E. Diller, Springfield, Ohio

[73] Assignee: Dresser Industries, Inc., Dallas, Tex.

[21] Appl. No.: 41,289

[22] Filed: May 22, 1979

[51] Int. Cl.[3] ..... B21D 39/10

[52] U.S. Cl. ..... 72/122; 72/125; 72/393

[58] Field of Search ..... 72/120, 122, 123, 125, 72/393

[56] References Cited

U.S. PATENT DOCUMENTS

| | | | |
|---|---|---|---|
| 324,007 | 8/1885 | Cashin | 72/125 |
| 488,589 | 12/1892 | Warden | 72/122 |
| 3,426,565 | 2/1969 | Schott | 72/122 |
| 3,924,433 | 12/1975 | Martin | 72/125 |
| 4,099,400 | 7/1978 | Schott | 72/122 |

*Primary Examiner*—Lowell A. Larson

*Attorney, Agent, or Firm*—J. N. Hazelwood; R. L. Van Winkle

[57] ABSTRACT

A tube expander having a stop collar for limiting the axial movement of the tube end relative to the expander to prevent damage to the tube end. The stop collar is comprised of a hollow stop collar body having the end adjacent to the tube end slotted to slidingly receive a pair of stop members that can be moved relative to each other to vary the size of the aperture extending through the stop collar body. The stop collar members substantially encircle the cage and have surfaces thereon that engage the end of the tube.

5 Claims, 3 Drawing Figures

STOP COLLAR FOR TUBE EXPANDER

BACKGROUND OF THE INVENTION

This invention relates generally to an improved tube expander. More particularly, but not by way of limitation, this invention relates to an improved stop collar for a tube expander that prevents damage to the tube end during a rolling or expanding operation.

Examples of stop collar apparatus utilized in connection with tube expanders in the past, can be found in U.S. Pat. No. 3,426,565 issued to Donald E. Schott, Feb. 11, 1969 and in U.S. Pat. No. 3,924,433 issued Dec. 9, 1975 to Paul W. Martin.

In the 3,426,565 patent, there is illustrated a stop collar having a circular stop member located therein that is of the split-ring type. The 3,924,433 patent illustrates a stop collar that utilizes a plurality of finger-like members that extend into the interior of the stop collar to engage the end of the tube being expanded. Both of the stop members described are capable of functioning to prevent the entrance of the tube end into the tubing roller and, thus, are effective to prevent tube end damage.

A stop collar constructed in accordance with this invention, is an improvement over the stop collars and stop members described in the aforementioned patents. It is believed that this arrangement of stop collar and stop member is much simpler than that illustrated in the 3,924,433 patent and much stronger than that illustrated in the 3,425,565 patent. Yet, a stop collar constructed in accordance with the invention will be equally if not more effective in preventing damage to the tube end during the expanding operation.

Therefore, one object of this invention is to provide an improved stop collar that will prevent the entrance of the tube end into the tube expander and thereby prevent damage to the tube end during the expanding operation.

SUMMARY OF THE INVENTION

This invention then provides an improved tube expander that includes a rotatable tubular cage sized to be received in a tube end that is to be expanded. Forming rollers, carried by the cage, engage the interior of the tube and a tapered mandrel that extends through the cage, drives the cage and rollers to expand the tube. The improvement comprises a relative non-rotatable stop collar that includes a hollow, generally cylindrical stop collar body that encircles a portion of the mandrel and cage that is rotatable relative thereto and has a first end located adjacent the tube end. The stop collar also includes stop means slidingly connected to the first end of the stop collar body that form a variable aperture generally encircling the cage for engaging the tube end to limit the movement of the tube into the expander and thereby prevent damage to the tube end.

BRIEF DESCRIPTION OF THE DRAWING

The foregoing and additional objects and advantages of the invention will become more apparent as the following detailed description is read in conjunction with the accompanying drawing, wherein like reference characters denote like parts in all views and wherein.

DETAILED DESCRIPTION OF THE PREFERRED EMBODIMENT

Figure 1:
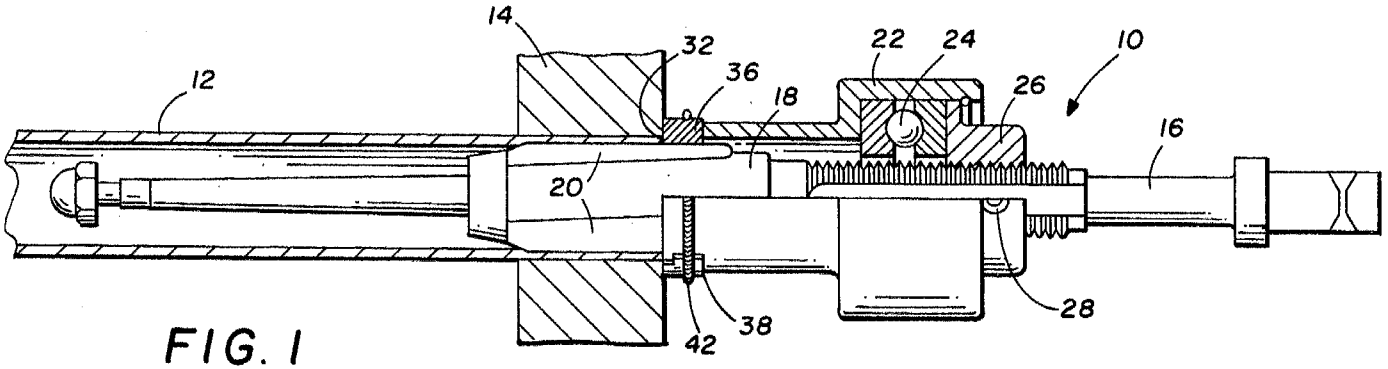
FIG. 1 is a view, partly in cross-section and partly in elevation, of a tube expander constructed in accordance with the invention.

Referring to the drawing, and to FIG. 1 in particular, shown therein and generally designated by the reference character 10 is a tube expander constructed in accordance with the invention. As illustrated therein, the tube expander 10 is in position for rolling or expanding a tube 12 in a header 14. Although not illustrated, a driver for the expander 10 will be connected thereto and arranged to exert a rotational and axial force on a tapered mandrel 16 and a rotational force on a cage 18 through which the tapered mandrel 16 extends.

The cage 18 is arranged to contain a plurality of rollers that are slightly skewed relative to the longitudinal axis of the tapered mandrel 16 and the cage 18 so that as rotation is applied thereto, the rollers 20 tend to pull the tube expander 10 into the tubing 12.

Encircling a portion of the cage 18 and the tapered mandrel 16 is a stop collar 22. The stop collar 22 is rotatable relative to the cage 18 and mandrel 16 by virtue of a thrust bearing 24 that is located in the collar 22. The thrust bearing 24 is retained in position by a thrust plate 26 that is threadedly connected to the rear end of the cage 20 and secured thereto against rotation by a set screw 28. Stated in another way, the stop collar 22 may be considered to be stationary since it is in engagement with the header 14 while the remaining internal portions of the expander 10 are the parts that actually rotate.

Figure 2:
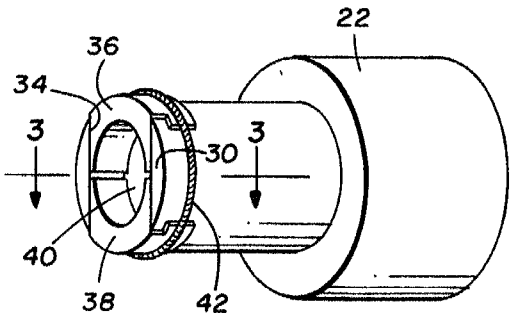
FIG. 2 is an enlarged, pictorial view of the stop collar of FIG. 1.
Figure 3:
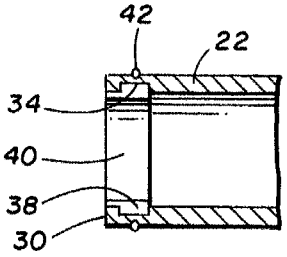
FIG. 3 is an enlarged cross-sectional view of a portion of the stop collar illustrated in FIG. 2 taken generally along the line 3—3 of FIG. 2.

Referring to FIGS. 2 and 3, it can be seen that the stop collar 22 has an end 30 that is disposed in engagement with the header 14 and with an end 32 of the tube 12 that is being expanded. The end 30 of the stop collar 22 is provided with a slot 34 that is much wider away from the surface thereon engaging the header 14 than it is immediately adjacent that surface. Slidingly disposed in the slot are a pair of stop members 36 and 38 that are movable toward and away from each other to vary the size of an aperture 40 that extends into the thrust collar 22. A spring member 42 is utilized to constantly urge the members 36 and 38 relatively together.

As illustrated in FIG. 1, the tube roller 10 is disposed approximately as it would appear when the tube rolling operation has been completed. As previously mentioned, the driver (not shown) will be attached to the tube roller 10 to provide for proper rotation and for the exertion of thrust on the tapered mandrel 16 to provide the expansion.

It is necessary that the aperture 40 be adjustable during the rolling operation so that as the rollers 20 are expanded outwardly to deform the tube end 32, and the aperture 40 can expand to accommodate the increased diameter across the rollers 20 as will be apparent from viewing FIG. 1. The stop members 36 and 38 must fit rather closely against the rollers 20 so that the tube end 32 cannot, during the rolling cycle, pass between the stop members 36 and 38 and the rollers 20.

The tendency for the tube end 32 to flow or be deformed into the interior of the tube roller 10 comes as a result of the skewed position of the rollers 20. Due to this arrangement, and as the tube expander 10 is rotated, the rollers 20 tend to screw themselves into the tube 12 and once they reach the maximum depth, any further rotation tends to deform the tube end 32 relatively toward the tube roller 10. Accordingly, the engagement of the tube end 32 with the stop members 36 and 38 results in the prevention of damage to the tube end 32.

It will be appreciated from the foregoing detailed description that the tube roller 10 including the stop collar 22 and the stop members 36 and 38 therein as described in detail hereinbefore, will be effective to prevent damage to the tube end, thus avoiding any fluid flow restrictions that might occur due to crimping the tube end 32 or avoiding leaks between the tube 12 and header 14 if the end 32 were severely deformed.

The foregoing detailed description is presented by way of example only and will be of course understood that many changes and modifications can be made thereto without departing from the spirit of the invention.

The embodiments of the invention in which an exclusive property or privilege is claimed are defined as follows:

1. In an improved tube expander including a rotatable tubular cage sized to be received in a tube end that is to be expanded, forming rollers carried by the cage for engaging the interior of the tube, and a tapered mandrel extending through the cage for driving the cage and rollers to expand the tube, the improvement comprising a relatively non-rotatable stop collar including:

a hollow, generally cylindrical stop collar body encircling a portion of the mandrel and cage and rotatable relative thereto and having a first end looted adjacent the tube end; and, stop means slidingly connected to said first end forming a variable aperture generally encircling said cage for engaging the tube end to limit the movement of said expander into the tube and thereby prevent damage to the tube end.

2. The improved tube expander of claim 1 and also including biasing means for urging said stop means toward a position closing said aperture.

3. The improved tube expander of claim 2 wherein:

said first end includes a diametrically oriented slot extending thereacross; and, a pair of stop members slidingly positioned in said slot for movement toward and away from each other thereby varying the size of said aperture.

4. The improved tube expander of claim 3 wherein:

said slot in the first end is wider relatively away from said first end; and, said stop members each have edge portions that are wider relatively away from said first end to fit into said slot and be retained therein.

5. The improved tube expander of claim 3 or 4 wherein said biasing means comprises a spring member encircling said first end in engagement with said stop members urging said stop members relatively toward each other.

* * * * *

UNITED STATES PATENT OFFICE

CERTIFICATE OF CORRECTION

Patent No. 4,242,893 Dated January 6, 1981

Inventor(s) Charles E. Diller

It is certified that error appears in the above-identified patent and that said Letters Patent are hereby corrected as shown below:

In the claims:

Column 4, line 4, first word, it should read --located-- instead of "looted".

Signed and Sealed this

*Twenty-first* Day of *April 1981*

[SEAL]

*Attest:*

RENE D. TEGTMEYER

*Attesting Officer* *Acting Commissioner of Patents and Trademarks*